US005305623A

United States Patent [19]

Kello

[11] Patent Number: 5,305,623

[45] Date of Patent: Apr. 26, 1994

[54] KEY OPERATED, COMBINATION CHANGING, LOCK

[76] Inventor: Endel Kello, 140 Fernandes Vieira St., Apt. 13 in Porto Alegre, State of Rio Grande do Sul, RS BOM FIN, Brazil

[21] Appl. No.: 95,067

[22] Filed: Jul. 20, 1993

Related U.S. Application Data

[63] Continuation of Ser. No. 791,029, Nov. 12, 1991, abandoned.

[30] Foreign Application Priority Data

Nov. 16, 1990 [BR] Brazil ..... 9005985

[51] Int. Cl.[5] ..... E05B 35/08

[52] U.S. Cl. ..... 70/338; 70/352; 70/383; 70/409; 70/DIG. 71

[58] Field of Search ..... 70/337-342, 70/352-355, 382-385, DIG. 44, DIG. 71, 409

[56] References Cited

U.S. PATENT DOCUMENTS

| | | | |
|---|---|---|---|
| 135,702 | 2/1873 | Bodmer | 70/355 |
| 666,697 | 1/1901 | Roche | 70/384 |
| 799,338 | 9/1905 | Horne | 70/339 |
| 1,092,414 | 4/1914 | Wellisch | 70/340 |
| 1,450,088 | 1/1923 | Kampmann | 70/355 |
| 4,691,545 | 9/1987 | Pagano | 70/352 |
| 4,958,508 | 9/1990 | Lin | 70/352 |

FOREIGN PATENT DOCUMENTS

| | | | |
|---|---|---|---|
| 5901257 | 1/1980 | Brazil . | |
| 196968 | 3/1908 | Fed. Rep. of Germany | 70/337 |
| 725690 | 9/1942 | Fed. Rep. of Germany | 70/340 |
| 1159306 | 12/1963 | Fed. Rep. of Germany | 70/352 |
| 1904486 | 9/1977 | Fed. Rep. of Germany | 70/339 |
| 663289 | 8/1929 | France | 70/352 |
| 284340 | 4/1931 | Italy | 70/352 |
| 2977 | 6/1888 | Sweden | 70/355 |
| 472563 | 6/1969 | Switzerland . | |
| 588001 | 5/1977 | Switzerland . | |
| 505958 | 5/1939 | United Kingdom | 70/382 |
| 757446 | 9/1956 | United Kingdom . | |
| 944354 | 12/1963 | United Kingdom . | |
| 1128461 | 9/1967 | United Kingdom . | |

*Primary Examiner*—Lloyd A. Gall
*Attorney, Agent, or Firm*—Harness, Dickey & Pierce

[57] ABSTRACT

A key-operated, combination changing, lock comprising a lock box, a slidable bolt and at least one bolt-retaining slider movable transversally across the bolt to retain the bolt in a resting and locking position, a bolt-locking arrangement being provided to hold the bolt once in the locking position. The bolt-locking arrangement comprising more than one locking plates capable of being actuated by at least one step of the key and being also capable of changing the combination of the lock when closed by a key different to the one used to lately open the lock. A key is also provided to operate the combination changing lock, having at least one bit step to actuate over the bolt-locking arrangement of the lock.

15 Claims, 6 Drawing Sheets

KEY OPERATED, COMBINATION CHANGING, LOCK

This is a continuation of U.S. patent application Ser. No. 07/791,029, filed Nov. 12, 1991, now abandoned.

BACKGROUND OF THE INVENTION

The present invention relates to key-operated locks, for any kind of doors, windows or openings wherein a bolt is needed to lock and keep closed a door or the like. Particularly, the invention relates to a lock of the kind comprising a key-operated bolt, movable between a resting position and a locking position and which is retained in each of these positions by one or more gated security levers or bolt-retaining sliders, either of the pivoted or sliding type, the sliders being required to be lifted by the key before the latter can operate the bolt. The invention particularly refers to the provision of a bolt-locking arrangement that is arranged to hold or retain the bolt in the locking-extended position. The lock of the invention is also a combination changing lock because the combination of the lock may be changed by simply using a key different to the one last used to open the lock. Thus, the lock of the present invention may be operated by two or more different keys.

Conventional locks comprise bolts which are slidably movably arranged within a lock box or case which in turn is located in, for example, a door to lock and keep the door closed against the frame or a wall opening. To move the bolt, between a locking extended position and a resting retracted position, a key is necessary having a bit with a plurality of steps, each step being intended to operate against one or more notches of the bolt. In order to keep the bolt locked in position, either in locking or in resting position, a plurality of security gated levers or bolt-retaining sliders are provided. The bolt usually has a stump extending transversely thereof and projecting from a side thereof. Each slider, in turn, has a window, gate, or a locking slot and the bolt stump extends through these slots. When the sliders are in a resting position, the locking slots retain the stump causing the bolt to be held against movement. When the sliders are lifted by the key steps, the locking slots become aligned so as to release the bolt stump whereby the bolt may be moved by at least one step of the key that engages the notches of the bolt. Thus, with the bolt released, the lock may be opened or locked.

The bolt retaining sliders are constantly biased by resilient means, such as a spring, towards the position is wherein the bolt stump is retained by the locking slots. Once the key has been rotated to slidably move the bolt, either to open it or to shut it, the key is removed from the lock whereby the bolt retaining sliders move downwardly to the resting position, under the action of the spring, and the bolt stump is retained by the locking slots of the sliders. The sliders also have notches to be operated, that is lifted, by the key steps. The different shapes of the sliders' notches and of the locking slots, as well as the different heights of the key steps are what is called the secrecy of the lock.

To guarantee the secrecy of the lock and avoid the possibility that any unauthorized person may open a lock, the quantity of sliders and consequently the number of the key steps have been increased. In this manner, the quantity of combinations of the lock have been considerably increased and the probabilities of lock violation have been thus reduced.

Conventionally, the quantity of sliders have increased from one or two sliders to more than four sliders and, recently, locks having eight sliders are in use.

Brazilian Patent application number MU 5,901,257, published on Jan. 29, 1980, refers to a lock having two dependent commands operating with two keys. Although the security of this lock is increased regarding other locks, the operation of this lock is complex and cumbersome.

U.K. patent No. 1,128,461 refers to improvements in key operated locks, the improvements being suitable for a suite of locks each operable individually by its own key, known as a single key, or by one or more master keys which may comprise the grand master, for a whole suite, or also a sub-master, for part of a suite.

U.K. patent No. 757,446 refers to lever locks for doors, wherein the key-operated bolt is detained in each of one of its extreme positions by one or more gated security levers, of either the pivoted or sliding type, which levers require to be lifted by the key before the latter can operate the bolt and the invention is particularly concerned with differing and master-keying as applied to this kind of lock.

U.K. patent No. 944,354 refers to an improved key controlled combination changing, permutation lock, particularly suitable for lockers and the like. The lock comprises a lock bolt movement controlling mechanism and a plurality of tumbler discs operativelly connected with said block bolt movement controlling mechanism, a turnable unitary dial and knob extending exteriorly of one side of the casing of the lock and operatively connected with the tumbler disc, a clutch plate included in said connections for transmittal rotation from the knob to the tumbler discs according to a preselected combination, the knob being provided to move the clutch plate for combination changing proposes while a key is also required.

Argentine patent No. 159,469 refers to an improved lock characterized in that the combination sliders are not biased by any kind of spring while they retract to the resting position under the gravity force when the key is removed from the lock.

Swiss patent Nrs. 472,563 and 588,001 refer to locks wherein a lever is actuated together with a locking element to close the lock. When the lever is moved said locking element is released.

The above cited prior art does not overcome the problem of modifying the combination of the lock unless the shape of the sliders' notches are modified together with the steps of the key bit. This requires removal of the lock from the door and opening of the lock box to modify the sliders by removing material thereof.

The question of the secrecy of a lock is a very important problem that has not been solved. Although a lock may be very complex and sophisticated, an unauthorized person may have access to the keys of the lock and may obtain copies thereof to then open the lock. This may lead to serious consequences when a key is stolen and copied with intention of violating a house to rob, kidnap or commit any kind of crime. There are criminal gangs that pay rich families' maids for keys that have been stolen from the family in order to then break into the house.

Conventionally, the keys are operated by turning them about two or more rounds, however, in an attempt to overcome the above problems it is quite usual to use an extra key in order to provide a further rotation with a different secrecy. Although this allows the user to have control on the keys of the lock, the use of a second key is cumbersome, and the problem is not entirely solved.

SUMMARY OF THE INVENTION

It is an object of the present invention to provide a lock that overcomes the above cited problems. The lock of the present invention provides a bolt-locking arrangement that holds the bolt once it has been moved to its end locking extended position once the key has been rotated the last turn. The bolt is held in position by a locking block that abuts a rear end of the bolt in order to retain it against movement when the bolt is shot. The lock can neither be opened by a picklock nor by boring out or drilling holes because of the presence of the locking block.

The invention also provides a key which has a bit including steps, with at least one step larger or higher than the other steps, the function of which is to move a slidable locking plate which in turn actuates the locking block.

The lock also comprising a plurality of bolt retaining sliders, parallelly arranged and separated by stationary anti-adherent plates, each slider having a notch capable of being actuated by the steps of the key bit. The sliders' notches are located in different positions or have different depths in order to be actuated by steps having different heights.

It is another object of the invention to provide a combination changing lock comprising slidable locking plates, parallelly arranged and separated by stationery plates. Each locking plate having a notch and all the notches may have different positions and/or different dephts. These notches are intended to be actuated by the highest step of the key. If the bolt-locking arrangement has five locking plates the lock may be used with five different keys and each locking plate will be actuated by the highest key step, namely the locking plate-actuating step. The locking plate, in turn, will actuate the locking block to hold the bolt in the locking position.

Although many different keys may be used in the same lock of the present invention, without removing the lock from the door or modifying the shapes of its elements, the lock can be opened only by the key used to close it, that is to shut the bolt. However, a different key may be then used to close again the lock and only such lately used key may be used to reopen the lock. Each different key will actuate on a different locking plate.

It is another object of the invention to provide a key-operated, combination changing, lock comprising a lock box, a longitudinally slidable bolt, movable between a locking extended-position and a resting retracted-position, at least one bolt-retaining slider, movable transversely across the bolt, the slider having at least one locking slot for receiving a stump transversely extending and projecting from the bolt, the slider being constantly biased by a spring so as to hold the bolt, through the stump, either in the locking position or in the resting position, the bolt and the slider having notches in order to be actuated by the bit steps of a key, for lifting the slider, releasing and moving the bolt, a bolt-locking arrangement being provided which comprises a locking block actuated by at least one slidable-locking plate, each locking plate having a notch through which the plate may be actuated by a bit step of the key.

It is another object of the invention to provide a key to operate a combination changing lock which comprises at least one locking plate that actuates a locking block capable of holding a bolt of the lock in a locking extended position, the key comprising a stem that, at one end, has a bit including a plurality of lock-actuating steps two locking plate-actuating steps being provided and being identical and higher than the other steps, each of these two plate-actuating steps being located at opposite sides of the stem and at opposite sides of a mid-line of the key bit, the mid-line extending perpendicularly across the stem. This arrangement is particularly for locks that have access through both opposite sides thereof.

For a lock that may be operated only through a side thereof, that is, that has only one keyhole, the key comprises a stem that, at one end, has a bit including a plurality of lock-actuating steps and a locking plate-actuating step which is higher than the other steps, this plate-actuating step being located at only one side of the stem.

The improved lock of the present invention may suitably be employed in houses, stores, banks, store houses, lockers, offices, security houses, safes, and in all rooms or places where security is an important matter. The lock of the present invention finds special application in situations where employees in charge of the security room are frequently changed. This is also important in houses wherein maids, chauffers, gardiners, etc., have access to the keys of the house.

The lock of the present invention may also be used in those locks that uses a latch and a knob.

The most relevant advantages and benefits of the present invention may be listed as follows:

In the case that the owner of a building has delivered a number of keys to employees thereof, the owner may cause such delivered keys become ineffective by using a different key to close the lock of the building.

The modification of the lock combination may automatically be done. In the case that the owner of the building is aware of that the key has been stolen, he has to merely close the lock with another different key and thus the combination of the lock is automatically changed and the new combination is given by the use of the new key. Thus, the keys already delivered to the employees are now invalid because they cannot open the lock. The owner however, may, in the future, use that key again to "reinstate" the former combination.

In the locks that may be operated only from one side thereof, the lock has as many secret combinations as locking plates are provided. However, in locks that have access from both sides thereof the number of combinations will be given by the half number of locking plates provided.

The lock is specially suitable in situations where the replacement of employees that have keys is constant.

These and other objects, features and advantages of the present invention will be more readily apparent from the detailed description of the preferred embodiments set forth herein below taken in conjunction with the accompanying drawings.

DETAILED DESCRIPTION OF THE PREFERRED EMBODIMENT

Figure 1:
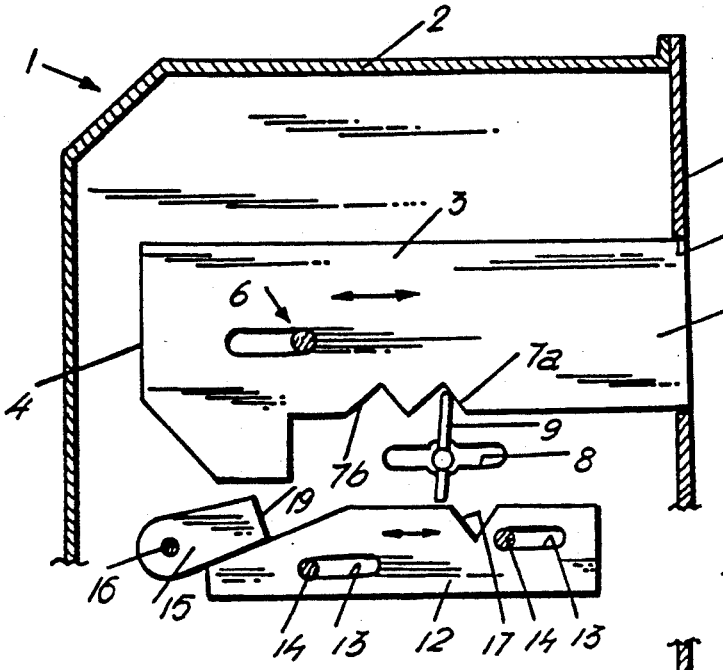
FIG. 1 is a schematic, fragmentary sectional view of a lock according to the invention, wherein the bolt-retaining sliders has been removed for clarity purposes, showing the bolt in a resting retracted position.

The lock 1 comprises a lock box or case 2 having a fore-end plate 10 with a window 11, through which a bolt 3 can slide, longitudinally guided by at least one pin-slot arrangement 6.

Bolt 3 may slidably move horizontally, as is shown by the arrows. Bolt 3 has a rear end 4 and a leading end 5, the function of the latter being to enter a cavity in a door frame, a wall or the like.

In order to be moved, bolt 3 has notches 7*a* and 7*b* capable of being actuated by a corresponding step of the bit of a key 9 which enters the lock case 2 through a keyhole 8.

When the key is inserted through the keyhole 8 and is rotated, the corresponding step "L" of the bit (see FIG. 9) will abut the notch 7*a* and move the bolt forwardly through a bolt intermediate position. If one keeps on turning the key around, the corresponding step of the key will abut notch 7*b* in order to move the bolt to reach the extreme locked extended position thereof. The above intermediate and locking extended positions of the bolt are shown in FIGS. 2 and 3, respectively.

Figure 12:
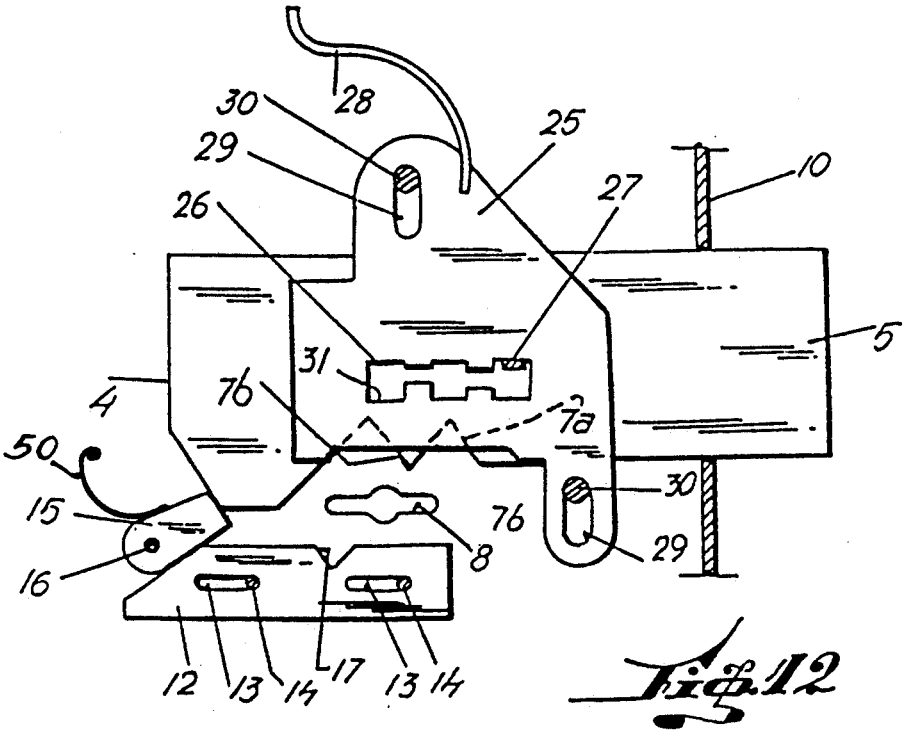
FIG. 12 is a view similar to that of FIG. 7 but showing a spring biasing the locking block.
Figure 13:
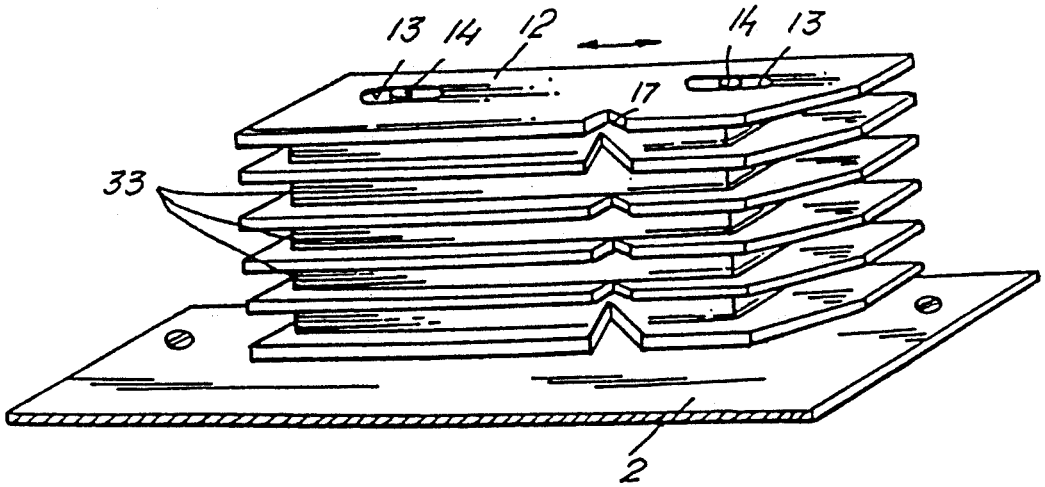
FIG. 13 is a view similar to FIG. 8 but showing different notches on the locking plate.
Figure 14:
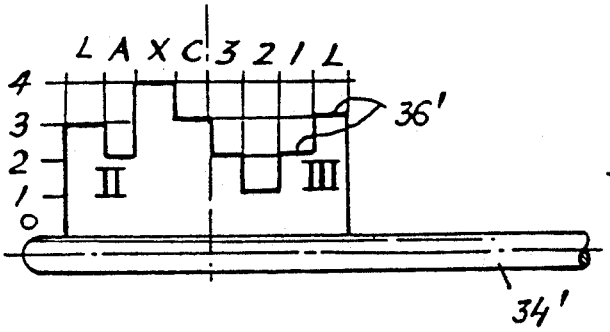
FIG. 14 is a view similar to FIG. 9 but showing the bit step on only one side of the key shank.

While bolt 3 is located adjacent to the keyhole 8, a bolt locking arrangement comprising at least one slidably mounting locking plate 12 which is intended to be actuated by one step of the key bit 9, is located under the bolt 3. Plate 12 has slots 13 which receive fixed pins 14 of the case 2 in order to allow plate 12 to move slidably, according to the arrows, for actuating a locking block 15 which, in turn, is pivotally mounted on a fixed pin 16 of the case of the lock box 2. Locking block 15 can move under the action of a spring 50 as shown in FIG. 12 or under the gravity force.

Although more detailed references will be made hereinafter, it may be said for the time being that plate 12 is moved by a step X (see FIG. 9) which abuts notch 17 of plate 12.

Figure 2:
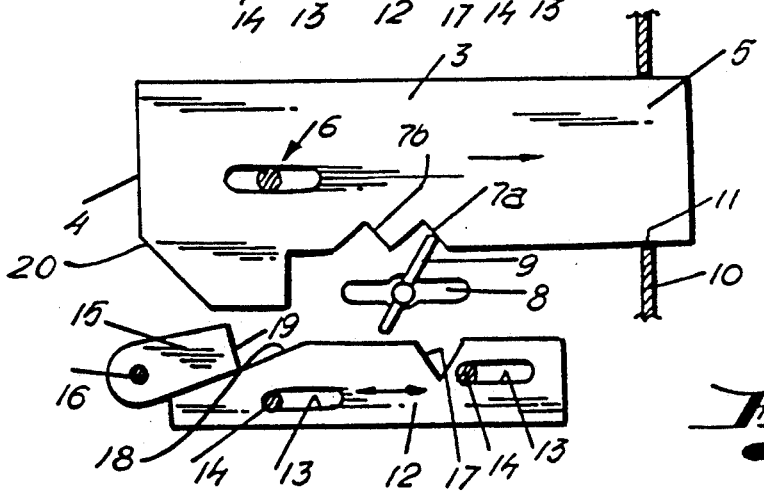
FIG. 2 is a view identical to FIG. 1, showing the bolt of the lock in an intermediate position.
Figure 3:
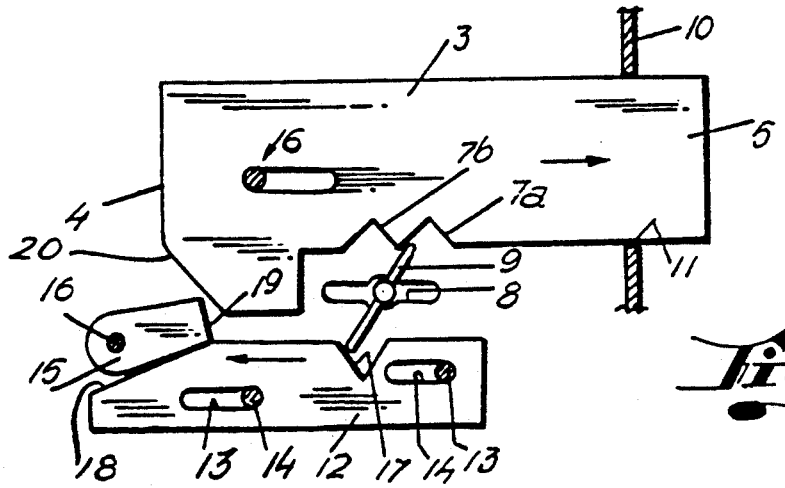
FIG. 3 is a view identical to FIGS. 1 and 2, showing the bolt in the locking extended position.

As may be seen from FIGS. 2 and 3, when bolt 3 is upon reaching its locked extended position, step X of bit 35 of the key 9 will actuate against notch 17 in order to move plate 12 to the left , as shown in FIG. 3, and a beveled face 18 of the plate 12 will act against the locking block 15 causing it to rotate counter-clockwise in order to locate a stop face 19 thereof against rear end 4 of bolt 3. A beveled face 20 may be provided in the rear end 4 of bolt 3 in order to assist the engagement between stop face 19 and bolt 3. As may be seen from FIG. 3, pins 14 are located at the right end of the guide slots 13. To be in a position shown in FIG. 3, the key has been rotated along 360°.

Figure 4:
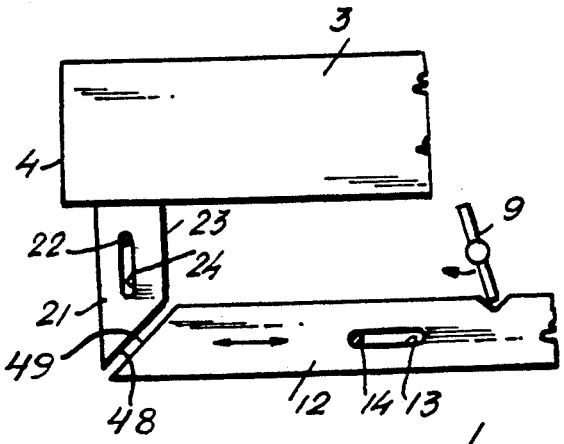
FIGS. 4 and 5 schematically show an alternative embodiment of the lock of the present invention, showing the bolt in the two extreme resting and locking position, respectively.
Figure 5:
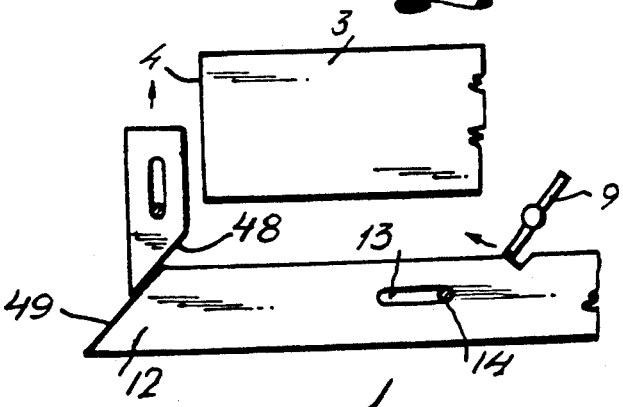

In FIGS. 4 and 5 another embodiment is shown and those parts that are equivalent to those shown in FIGS. 1 to 3, are indicated by the same reference number.

In this embodiment, the locking block 15, that in FIGS. 1 to 3 is pivotally mounted, is here replaced by a slidably mounted locking block 21 that has a guide slot 24 receiving a pin 22 for the block to be slidably arranged. The rear end 4 of the bolt 3 is abuted by the stop face 23 when the block 21 is lifted thanks to the combination of abuting faces 48 of the locking block 21 and face 49 of the locking plate. Faces 48 and 49 are inclined or beveled in order that the horizontally slidably movement of the plate 12 causes the block 21 to lift and hold bolt 3 in the locking position shown in FIG. 5.

Figure 6:
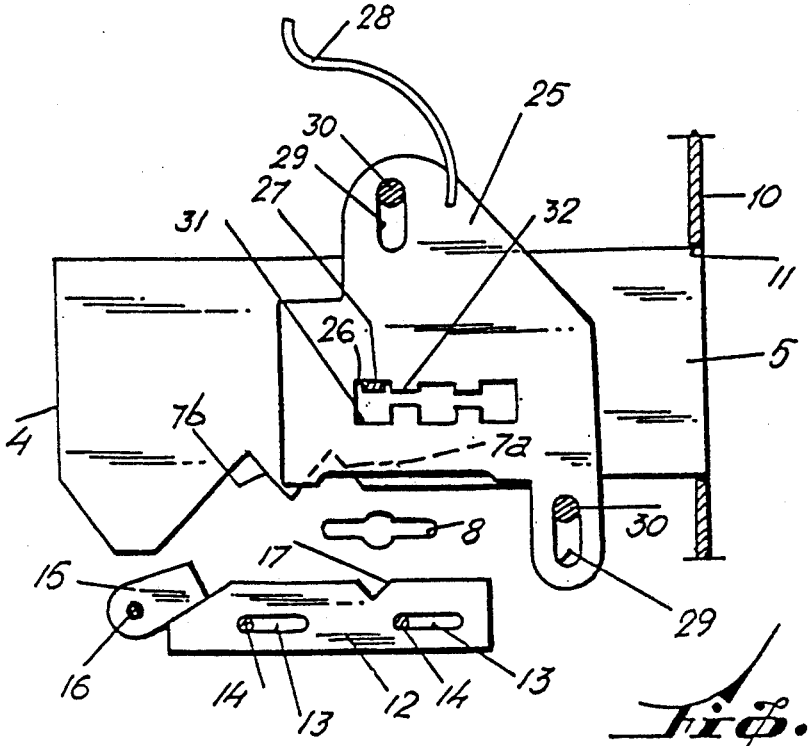
FIG. 6 is a schematic view of the inner elements of the lock in the present invention.
Figure 7:
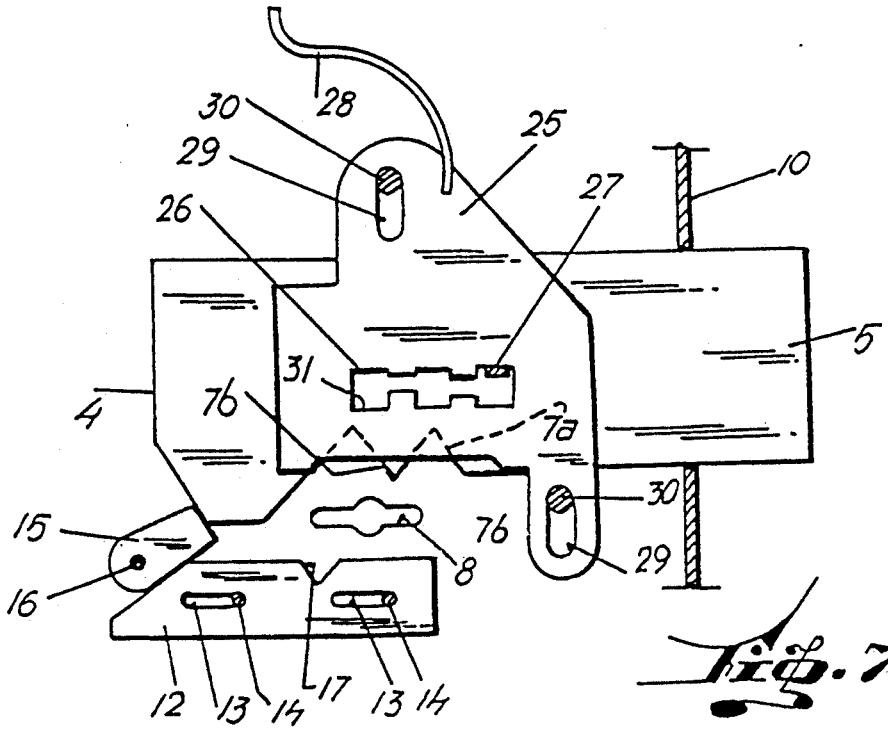
FIG. 7 is a view similar to that one of FIG. 6 that illustrates the bolt in the locking extended position.

FIGS. 6 and 7 illustrate the lock of the present invention including the bolt-retaining sliders 25. Sliders 25 are constantly resiliently biased by a spring 28 that urges sliders 25 downwardly. Sliders 25 are slidably mounted through notches 29, each notch receiving a fixed pin 30 of the case or lock box 2. Slider 25 has a locking slot or gate 26 having wide portions 31 connected by narrow portions 341. Bolt 3 has a transversally extended stump 27 that projects and extends through the locking slot 26.

When slider 25 is in a lower position, shown in FIGS. 6 and 7, stump 27 is retained in one of the wide portions 31. When slider 25 is lifted (position not shown) stump 27 is aligned with the narrow portion 32 so as to be capable of passing therethrough and being located in any one of the two remaining wide portions 31. With the stump 27 aligned with the narrow portion 32, bolt 3 may be moved by the corresponding bit step of the key and stump 27 can move along portions 32 and 31. In FIG. 6, bolt 5 is illustrated in the wide resting retracted position and stump 27 is shown in the left-side wide portion 31. When bolt is shut and located in the locking extended position, stump 27 is located at the right-side wide portion 31 illustrated in FIG. 7. Thus, bolt 3 is retained in position because stump 27 is retained by the corresponding portion 31 of the locking slot 26.

Since many sliders 25 are provided in order to increase the security of the lock, each locking slot 26 will be different for each slider 25 defining the secrecy of the lock. Locking plate 12 will be operated in the same manner as in the lock illustrated in FIGS. 1 to 4 and 5.

Figure 8:
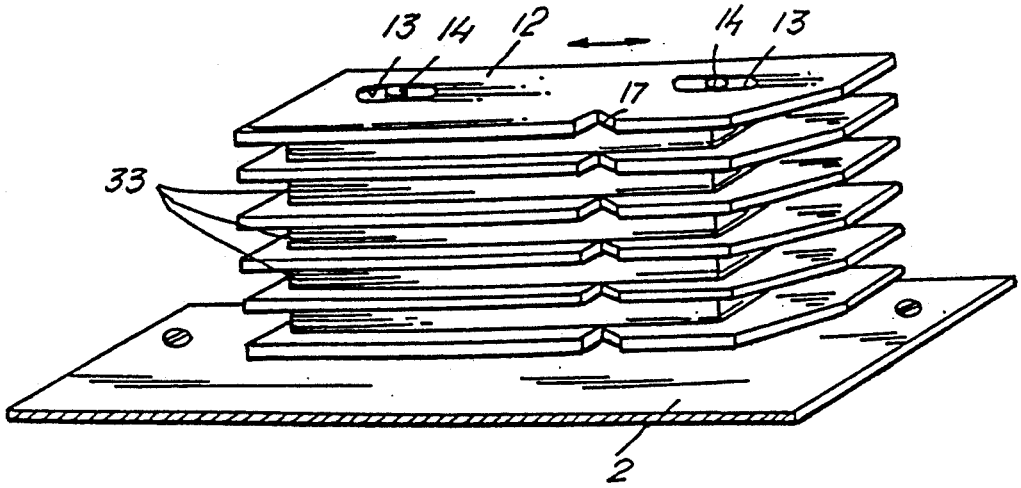
FIG. 8 is a perspective view of the locking plates of the present invention.

FIG. 8 illustrates the bolt-locking arrangement comprising a plurality of parallely arranged locking plates 12 which are separated by stationary and anti-adherent plates or separators 33. As may be seen, each locking plate 12 has a notch 17 and these notches 17 may have different positions and may have different shapes as shown in FIG. 3 and is to be actuated by only one step, the X step (see FIG. 9), of the key bit. Although X step is the highest one, this step may have different heights for different keys. Generally, the corresponding locking plate 12 is actuated once the key bas been turned around 360°. This will obviously depend on the quality of notches 7a and 7b provided in bolt 3. Only one locking plate 12 is needed to be slidably moved to the position wherein it acts on the locking block 15; this will be enough to hold bolt 3 in the locking position. After the lock has been closed by a determined key, only that key will be able to open it again. However, after being opened by such a determined key, the lock can be closed by another different key whereby the combination of the lock is thus modified. Now, the lock operates only with this new key.

Figure 9:
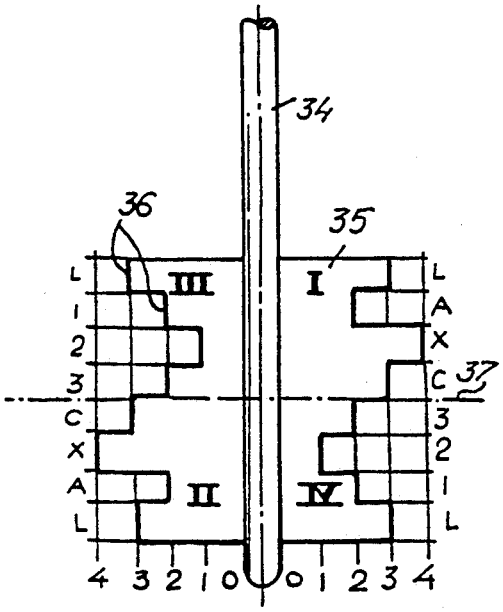
FIG. 9 is a plan view of the bit steps of a key to be used with a lock of the present invention, the lock having a keyhole at each side thereof.

FIG. 9 illustrates a bit with the steps according to the present invention. Key 9 comprises a stump 34 and a key bit 35 containing a plurality of steps 36. In the case the lock in use has access either by the inner side of the building or by the outer side of the building, bit 35 of the invention is divided in four portions, namely a right-hand upper portion 1, left-hand upper portion III, left-hand lower portion II and right-hand lower portion IV. The different heights of the steps 36 may be designed according to a grid, as shown in FIG. 9 to define a combination of the lock. When a lock bas only access from one side thereof, the bit of the key will have only portions I and III or II and IV, that is, only the half, either the upper or the lower portions of the bit, divided by axes 37 as shown in FIG. 4.

Portions I and 11 are diagonaly-corresponding portions, that is, the bit steps of the right-hand upper portion I are a mirror image of the bit steps of the left-hand lower portion II but rotated 180°. The same is applicable to the diagonally corresponding portions III and IV. The steps L are for moving bolt 3. Steps 1, 2 and 3 are for moving sliders 25 upon the first turn of the key, while the step A, X and C are for moving sliders 25 in the second turn of the key. Steps X operate furthermore to act against notch 17 to move the locking plate 12. The location of step X on the key bit will depend on which locking plate (see FIG. 8) is to be actuated on. Step X is the highest step regarding the remaining steps.

Figure 10:
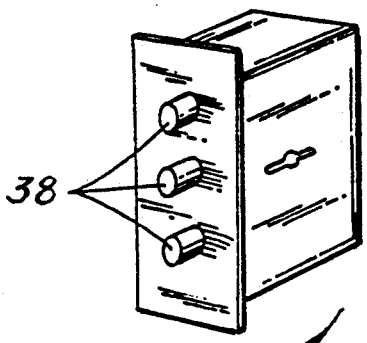
FIG. 10 is a perspective schematic view of a lock according to the present invention, including circular cross-section bolts.

FIG. 10 illustrates another embodiment wherein bolt 3 comprises a circular cross-section bar 38. Three bolts are illustrated in this embodiment.

Figure 11:
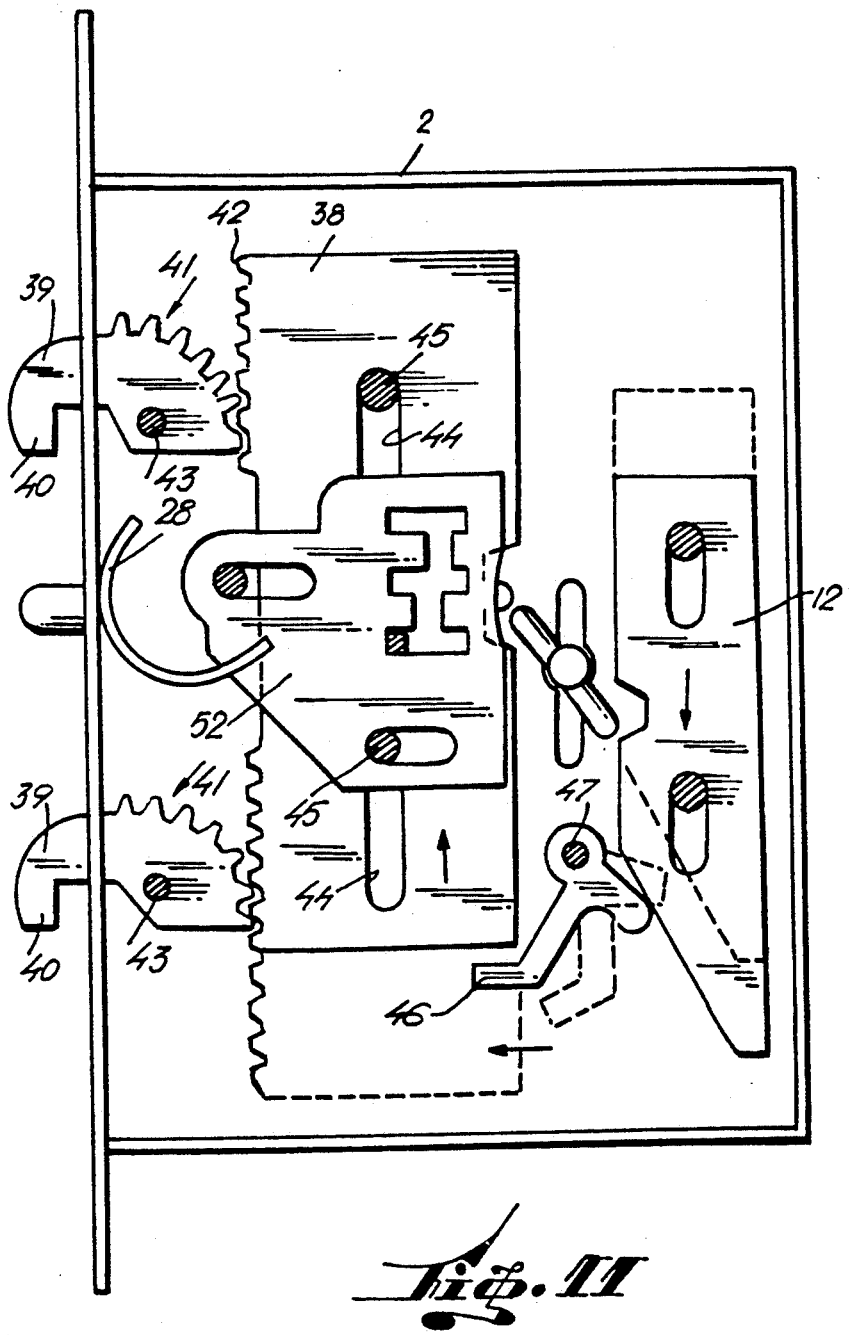
FIG. 11 is another alternative of the lock of the present invention, particularly for sliding doors.

FIG. 11 illustrates another embodiment of the lock of the present invention, particularly suitable for sliding doors, wherein bolt 3 has been replaced by a main bolt 38 and two curved-plate bolts 39, the latter having a leading portion 40, that is intended to enter the cavity of the wall or a door frame to lock the door, and a rear portion having a toothed curved periphery 41 that is engaged with a tooth edge 42 of bolt 38. Bolts 39 are respectively pivotally mounted on respective pins 43 while main bolt 38 is slidably mounted through guide slots 44 and pins 45.

The remaining elements of the lock are practically the same like in the aboved described embodiments, except that locking block 15 has a different shape and comprises an L-shaped locking block 46 pivotally mounted on a pin 47. The different positions of the locking plate 12 and locking block 46 are shown in full line (lock shut) and in phantom lines (lock open). Like in the other embodiments, locking block 46 may be actuated her by the force of a spring or by the force of gravity.

I claim:

1. A set of keys to operate a combination changing lock which comprises a bolt and bolt retaining means and a plurality of locking plates, any one of which actuates a locking block capable of holding said bolt of the lock in a locking extended position, each key comprises a stem that, at one end, has a bit including a plurality of lock-actuating steps which operate to release said bolt retaining means and actuate said bolt and, a locking plate-actuating step being provided, which is higher than the other steps, said locking plate-actuating step of said keys being operable to move said locking plates thereby actuating said locking block only when said bolt is in said locking extended position, each key having its respective plate-actuating step in a position different from the position in which the plate-actuating step are located in the remaining keys whereby each of said keys is operable to set a combination for said lock upon actuation of said lock different from the combination set by any other key of said set of keys.

2. A key-operated, combination changing, lock adapted to be actuated by bit steps of a plurality of keys having different shapes, each key being capable of actuating said lock individually without the need of a servant key, the lock comprising a lock box, a longitudinally slidable bolt movable between a locking extended-position and a resting retracted-position, at least one bolt-retaining slider movable transversely across the bolt, said slider being capable of being actuated by any one of said keys, the slider having at least one locking slot for receiving a stump transversely extending and projecting from the bolt, the slider being constantly biased by a spring so as to hold the bolt, through the stump, either in the locking position or in the resting position, the bolt and the slider having notches in order to be actuated by the bit steps of a key for lifting the slider and releasing and moving the bolt, a bolt-locking arrangement being provided which comprises a plurality of slidable locking plates, a locking block positioned to be actuated by any one of said plurality of slidable locking plates, each locking plate having a notch therein adapted to cooperate with a selected bit step of each of said different shaped keys whereby a selected one of said different shaped keys is operable to effect sliding movement of a selected one of said locking plates thereby actuating said locking block, said locking block being operative while actuated to prevent movement of said bolt into said resting position, deactuation of said locking block requiring movement of said one of said locking plates by said one of said different shaped keys to thereby enable movement of said bolt into said resting position, whereby said combination of said lock is changed by each of said plurality of different shaped keys.

3. A key-operated combination changing lock, according to claim 2, wherein the bolt has a rear end and a leading end, the leading end being provided to enter a cavity of a wall and the locking block is located at the rear end of the bolt to hold the bolt in the locking extended-position.

4. A key-operated combination changing lock, according to claim 3, wherein the locking block is biased by a spring towards a resting position wherein the bolt is released.

5. A key-operated combination changing lock, according to claim 4, wherein the locking block is pivotally mounted on a fixed pin of the lock box and abuts a beveled end of each of said locking plates.

6. A key-operated combination changing lock, according to claim 4, wherein the locking block is slidably mounted on at least one fixed pin of the lock box and abuts a beveled end of each of said locking plates.

7. A key-operated combination changing lock according to claim 4, wherein each of the locking plates is slidably mounted by means of guide slots which receive respective fixed pins of the lock box, said slots and said pins defining a longitudinal path of movement parallel to the bolt.

8. A key-operated combination changing lock according to claim 4 wherein each of said locking plates has a different notch capable of being actuated by a selected bit step of said plurality of keys having different shapes so as to be capable of changing the combination of the lock by using each of said plurality of different keys to shut the bolt.

9. A key-operated combination changing lock according to claim 8, wherein the notches of the locking plates are arranged in different positions and have different shapes whereby each locking plate may be slidably moved by a bit step that is located in a different location in each of several key bits.

10. A key-operated combination changing lock according to claim 9, wherein the bolt comprises a rectangular cross section bar.

11. A key-operated combination changing lock according to claim 9 wherein the bolt comprises a circular cross section bar.

12. A key-operated, combination changing, lock according to claim 2, wherein said bolt comprises at least one curved-plate bolt and a main bolt, the curved-plate bolt having a leading locking-portion and a rear portion having a toothed curved-periphery, the curved-plate bolt being pivotally mounted on a fixed pin of the lock box, the main bolt being slidably arranged on two fixed pins of the lock box and is actuated at one edge thereof, by a key, and the main bolt having another toothed edge, opposite to said one edge, engaged with said toothed curved-periphery of the curved-plate bolt, to move the latter between a locking position and a resting position.

13. A combination changing lock and a plurality of keys for actuating same comprising:

each of said keys having a plurality of bit steps;

a bolt movable between a locking extended position and a resting retracted position, said bolt including a stump;

a bolt retaining slider movable relative to said bolt and including locking means cooperating with said stump to retain said bolt in said resting position and in said locking position, said slider being movable by the action of selected ones of said bit steps of each of said keys to thereby release said locking means and allow movement of said bolt, selected ones of said bit steps of each of said keys being operable to effect movement of said bolt while said locking means is released, a plurality of movable locking plates and a locking block actuable by any one of said locking plates, each of said keys including a stem, said key bit steps projecting outwardly from opposite sides of the stem and two locking plate-actuating steps, both steps being identical and higher than the other steps, said two plate-actuating steps being located at opposite sides of the stem and at opposite sides of a mid-line of the key bit steps, the mid-line extending perpendicularly across the stem, said plate-actuating steps of a selected one of said keys being operative to effect movement of one of said locking plates to thereby actuate said locking block whereby said locking block operates to prevent movement of said bolt out of said locking position, use of said one of said plurality of keys being required to deactuate said locking block, each key having its respective plate-actuating steps in a position different from the position in which the plate-actuating steps are located in the remaining keys whereby said combination of said lock is changed by use of each of said plurality of keys.

14. A lock and keys according to claim 13, wherein the bits are formed by four portions, a left-hand upper portion, a right-hand upper portion, a left-hand lower portion and a right-hand lower portion; the left-hand portions being separated from the right-hand portions by the key stem while the upper portions being separated from the lower portions by the mid-line of the key bit, the locking plate-actuating steps are located in the left-hand lower portion and in the right-hand upper portion respectively.

15. A lock and keys according to claim 14, wherein the bit steps of the left-hand upper portion are a mirror image of, and rotated 180° regarding to, the bit steps of the right-hand lower portion, and the bit steps of the left-hand lower portion are a mirror image of, and rotated 180° regarding to, the bit steps of the right-hand upper portion of the key bit.

* * * * *